US005307724A

United States Patent [19]

Breuer et al.

[11] Patent Number: 5,307,724

[45] Date of Patent: May 3, 1994

[54] EJECTOR SYSTEM AND USE OF THE SYSTEM IN LARGE CALIBER GUNS

[75] Inventors: Heinz-Günter Breuer, Duisburg; Karl-Egon Janssen, Meerbusch, both of Fed. Rep. of Germany

[73] Assignee: Rheinmetall GmbH, Dusseldorf, Fed. Rep. of Germany

[21] Appl. No.: 959,376

[22] Filed: Oct. 13, 1992

[30] Foreign Application Priority Data

Oct. 10, 1991 [DE] Fed. Rep. of Germany ..... 4133618

[51] Int. Cl.[5] ..... F41A 15/10

[52] U.S. Cl. ..... 89/24; 42/25

[58] Field of Search ..... 42/23, 24, 25; 89/1.704, 1.705, 4.2, 24, 167, 186

[56] References Cited

U.S. PATENT DOCUMENTS

| | | | |
|---|---|---|---|
| 306,144 | 10/1884 | Finch | 42/24 |
| 614,821 | 11/1898 | Baldwin | 89/24 |
| 2,489,747 | 11/1949 | Burney | 89/1.704 |
| 2,953,066 | 9/1960 | Colby | 42/25 |

FOREIGN PATENT DOCUMENTS

| | | | |
|---|---|---|---|
| 46502 | 2/1911 | Austria | 42/23 |
| 277213 | 7/1914 | Fed. Rep. of Germany . | |
| 371662 | 3/1923 | Fed. Rep. of Germany . | |
| 724802 | 4/1937 | Fed. Rep. of Germany . | |
| 349506 | 11/1960 | Switzerland . | |
| 670502A5 | 6/1989 | Switzerland . | |
| 2778 | of 1853 | United Kingdom | 42/23 |

*Primary Examiner*—Stephen C. Bentley

*Attorney, Agent, or Firm*—Spencer, Frank & Schneider

[57] ABSTRACT

An ejector system for the extraction of cartridge casings from a tubular weapon provided with two ejector levers that are pivotal about an axis. Prior art ejector systems of this type have the drawback in that the ejector claws which pull the cartridge casing out of the cartridge chamber after firing are fastened directly to the ejector levers so that, due to the circular arc movement of the ejector claws, the cartridge casings are ejected in an undefined direction of flight from round to round. However, large caliber weapons, particularly those equipped with automatic loading mechanism, require a defined ejection path of the cartridge casings. To avoid the above drawbacks, the disclosed ejector system fastens each ejector claw to an ejector that is linearly displaceable parallel to the longitudinal axis of the gun barrel. The ejectors in turn are provided with respective recesses into which the ejector levers engage in a displaceable manner so that, when the ejector levers are pivoted, the ejectors are displaced linearly.

5 Claims, 2 Drawing Sheets

EJECTOR SYSTEM AND USE OF THE SYSTEM IN LARGE CALIBER GUNS

BACKGROUND OF THE INVENTION

The present invention relates to an ejector system for the extraction of cartridge casings or casing bottoms from a tubular weapon provided with a breechblock wedge. More particularly the present invention relates to an ejector system which includes two ejector levers pivotally mounted for movement about an axis extending perpendicular to an axis parallel to the longitudinal axis of the barrel of the weapon and provided with respective ejector claws, and which is suitable for large caliber weapons, particularly in armored cannons.

An ejector system of the above-outlined general type is disclosed, for example, in Swiss Patent CH 0,670,502. The system disclosed in this patent extracts and ejects empty cartridge casings from the cartridge chamber of an automatic weapon with the aid of two ejector claws that are fastened to ejector levers. The ejector levers are mounted on a shaft and perform a circular arc pivoting movement when the cartridge casing is extracted. The result of this ejector movement, in which the direction of the ejector claws changes constantly, is that from round to round the cartridge casing has an undefined direction of flight.

Similar ejector systems are also employed in large caliber weapon systems, for example, in armored weapon systems. In such weapon systems, the undefined direction of flight of the cartridge casings or, if the casings are combustible, of the cartridge bottoms (bases, stub casings) creates problems of storage and discarding of the extracted casings. Furthermore, problems exist if automatic loading systems are employed which require uniform ejection of the cartridge casings.

SUMMARY OF THE INVENTION

It is an object of the present invention to provide an improved ejector system of simplified construction for the extraction of cartridge casings in which the cartridge casings or cartridge bottoms are ejected in a defined direction. Moreover, this ejector system should be particularly suitable for large caliber weapon systems employing automatic loaders.

This object and others to become apparent as the specification progresses are accomplished by the invention, according to which, briefly stated, the weapon includes a gun barrel and is provided with a breechblock wedge. The ejector system extracts a cartridge casing from the breech end of the weapon, and essentially is comprised of two ejectors having recesses, two ejector claws, and two ejector levers. Each ejector claw is fastened to a respective ejector. The ejector levers pivot about an axis which extends perpendicularly to an axis that is parallel to the longitudinal axis of the gun barrel. The ejectors are mounted for linear displacement parallel to the longitudinal axis of the gun barrel and the ejector levers extend into the respective recesses of the ejectors in a displaceably engageable manner. When the ejector levers are pivoted, the ejectors are linearly displaced parallel to the longitudinal axis of the gun barrel.

The invention is thus essentially based on the concept of transforming the pivoting movement of the pivotal ejector levers into a linear ejection movement of the ejector claws parallel to the axis of the gun barrel. Preferably the pivoting movement of the ejector levers is initiated by the opening of the breechblock wedge. Moreover, the ejector claws may be fixed to the respective ejectors or may be pivotally mounted on the respective ejectors to permit extraction of cartridge casings which have a radial collar or an extraction groove.

DETAILED DESCRIPTION OF THE PREFERRED EMBODIMENT

Figure 1:
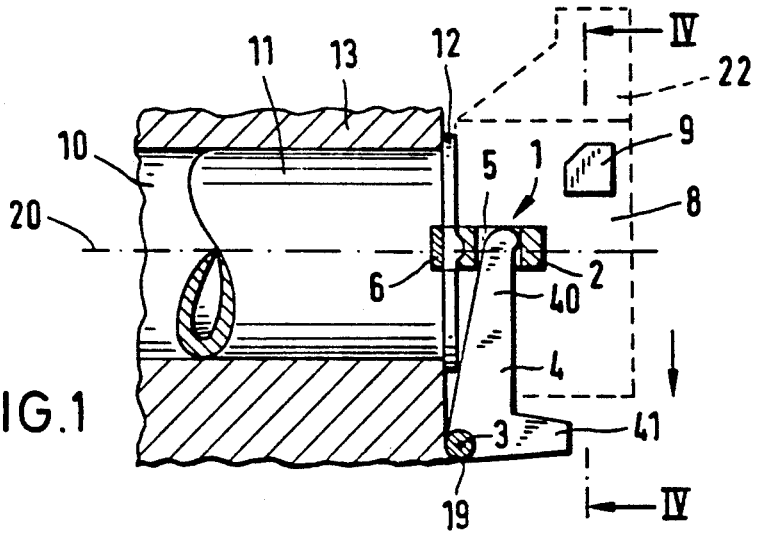
FIGS. 1 to 3 are schematic longitudinal sectional views of a portion of the breech end of a weapon including an ejector system according to the present invention during the extraction of a cartridge casing provided with a collar at three different times of the breechblock.
Figure 2:
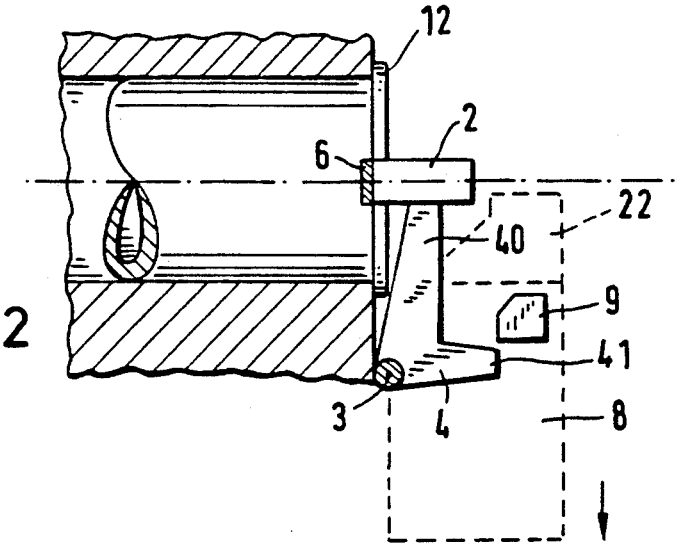
Figure 3:
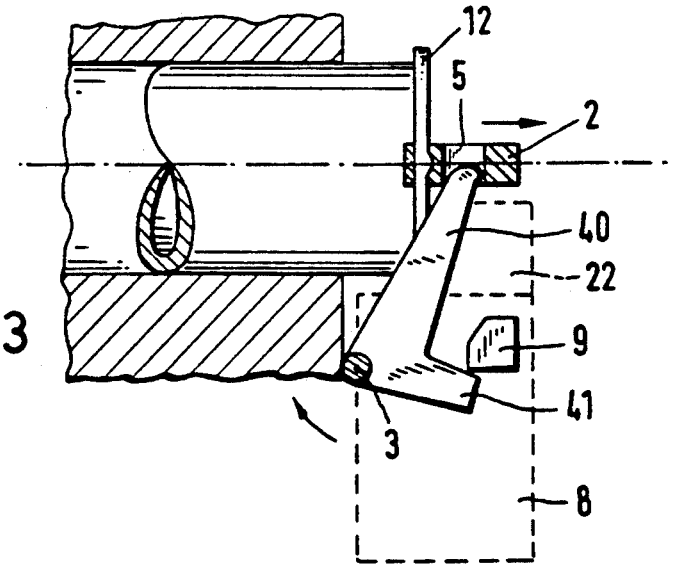

Referring now to FIGS. 1 to 4, there is shown the breech end of a gun barrel 13 of a weapon (not further shown in detail) including an ejector system 1 which is essentially composed of a pair of ejectors 2, 2' (see FIG. 4) and respective ejector levers 4, 4'. The levers 4, 4' are attached to a shaft 19 mounted at the breech end of the barrel complete 13, allowing for pivotal movement about an axis 3 extending perpendicular to an axis parallel to the longitudinal axis 20 of a gun barrel. An ejector claw 6 or 6' is fastened to the respective ends of the ejectors 2, 2' facing the cartridge cases 11 to be ejected. Each ejector lever 4, 4' is L-shaped and as shown in FIGS. 1-3 is comprised of two arms 40, 41. The outer end of the longer arm 40 of ejector lever 4 slidably engages in a recess 5 of ejector 2 and is arranged in this recess 5 so as to be displaceable in the longitudinal direction. The outer end of the longer arm of the ejector lever 4' is similarly engaged in a corresponding recess in the ejector 2'. The significance of the shorter arm 41 of ejector lever 4 will be discussed below.

In addition to the ejector system 1, FIGS. 1 to 3 depict in dashed lines a (drop) breechblock wedge 8 that is provided with a cam 9 positioned to engage the shorter arm 41 of the lever 4 to pivot same when the breechblock 8 drops as shown in FIG. 3. Preferably, a similar cam (not shown) is disposed on the breechblock 8 to engage the shorter arm of the lever 4'. Additionally illustrated is a cartridge chamber 10 in which is disposed the cartridge casing 11 to be extracted which, as shown, is provided with a radial casing collar 12.

Figure 4:
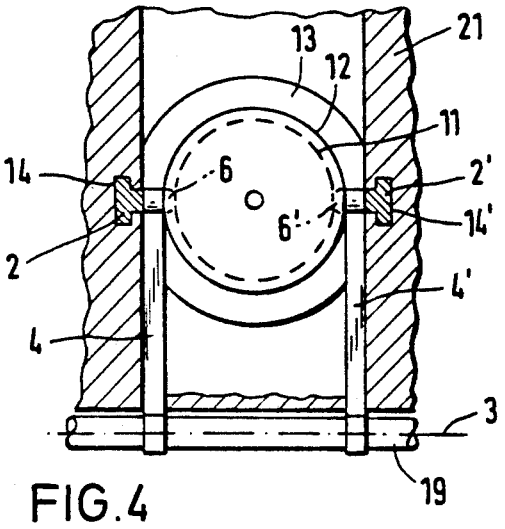
FIG. 4 is an end view seen along the section line IV—IV of FIG. 1 while omitting the breechblock wedge.

FIG. 4 is an end view of the weapon with the cartridge casing 11 and the ejector system according to the invention viewed along the section line marked IV—IV in FIG. 1, but with the breechblock wedge 8 not shown for reasons of better clarity. As can be seen in this figure, ejectors 2 and 2' and their respective ejector claws 6 and 6' as well as the respective ejector levers 4 and 4' are disposed symmetrically to the gun barrel axis 20. Each of the ejectors 2 and 2' has a T-shape and is guided in a respective T-groove 14, 14' formed in the weapon breech ring 21 and extending parallel to the longitudinal axis 20 of the gun.

Figure 5:
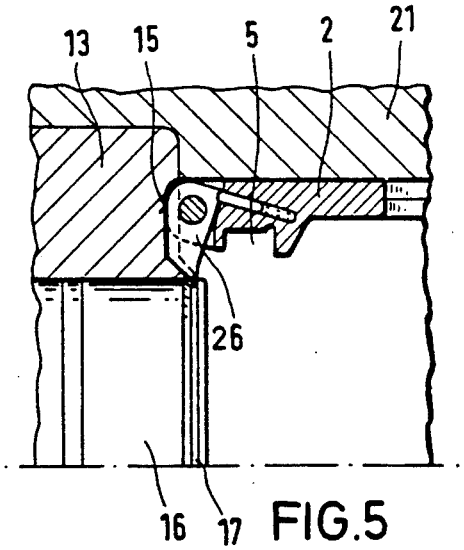
FIGS. 5 and 6 are schematic partial longitudinal sectional views showing an ejector system according to the invention with modified ejector claws in two different positions while pulling out a cartridge casing having an extractor groove.
Figure 6:
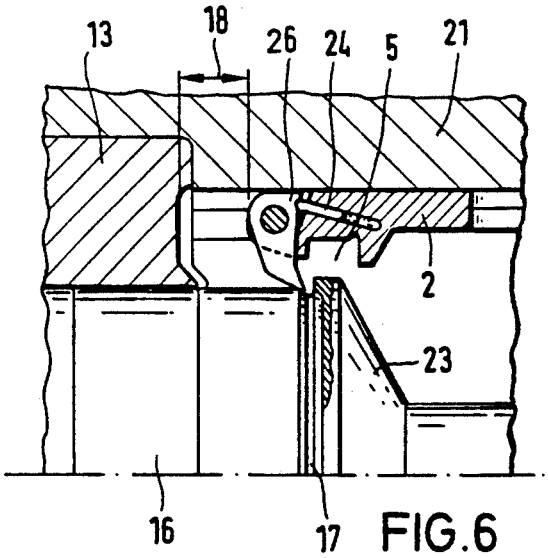

In another embodiment shown in FIGS. 5 and 6, an ejector 2 provided with a movable ejector claw 26 is shown during the extraction of a cartridge casing bottom or base 16 provided with an ejector groove 17. In these figures, reference numeral 5 again identifies the recess for the respective ejector lever 4 or 4', numeral 13 is the gun barrel, and numeral 15 an abutment at the gun barrel 13 for ejector 2 when in the firing position. While FIG. 5 shows the state of ejector 2 and its ejector claw 26 in the firing position, FIG. 6 depicts the corresponding stare of ejector 2 in the ejection position, with the ejector stroke being marked 18.

The operation of the ejector system according to the present invention FIG. 1–4 now be described in greater detail.

As indicated in FIG. 1, it is assumed that breechblock wedge 8 is closed in its starting position. Ejectors 2 and 2' as well as ejector levers 4 and 4' are disposed in the closed position. When breechblock wedge 8 (FIG. 2) is opened, the cams 9 provided on breechblock wedge 8 abut on the respective second arms 41 and thus cause the ejector levers 4 and 4' to pivot about axis 3 and ejectors 2 and 2' to perform a linear ejection movement into the ejection position (FIG. 3). Cartridge casing 11 is pulled in a straight line over the predetermined ejector stroke 18 in the direction along the gun barrel axis 20 from the cartridge chamber 10 (in large caliber weapons, from the charge chamber). The cartridge casing 11 is linearly accelerated and ejected in a defined direction.

At the end of this process, the closing energy stored in the counterrecoil portion of the gun barrel 13 closes the breechblock wedge 8 until its upper contact face lies against the ejectors 2, 2' in their ejection position and is retained there. Thus, the loading position is reached in which the cartridge casing 11 may be transported through the loading trough 22 of the breechblock wedge 8 into the cartridge chamber 10.

To load the weapon, the fresh cartridge 11 is pushed into the gun barrel 13 until the face of the casing collar 12 lies against the ejector claws 6 and 6' of ejectors 2 and 2'. Further advancement of the cartridge 11 into the closing position moves ejectors 2 and 2' along with the cartridge, and ejector levers 4 and 4' are pivoted into the closing position. Shortly before the closing position is reached, ejectors 2 and 2' release the breechblock wedge 8 which then, because of the closing forces acting on it, closes automatically.

Of course, ejector levers 4 and 4' need not be fastened directly to shaft 19 as shown in FIGS. 1 to 4. Rather, ejector levers 4 and 4' are often pivoted about this shaft as disclosed, for example, in the above described Swiss Patent CH 0,670,502. This has no significance for the operation of the ejector system according to the present invention.

The present invention is not limited to the extraction of cartridge casings 11 but can be employed with the same success for the extraction of casing bottoms or bases 16 in cartridges that have a combustible casing and a collar or an ejector groove 17. The use of the ejector system also has no limits with respect to the caliber of the gun, although it has been found particularly effective in large caliber weapons.

As shown in FIGS. 1 to 4, ejector claws 6, 6' may be fixed or rigidly fastened to respective ejectors 2 and 2' or, as shown in FIGS. 5 and 6, the ejector claws 26, 26' may be connected in a pivotal manner. In the latter case, a ram head 23 used during loading moves the ejector claws 26, 26' out of a non-engaged position with the casing bottom 16 (FIG. 6) against the pressure of a spring biased pin 24 into an ejector groove 17 provided in the casing bottom. This embodiment does not require the casing collar 12 described in connection with FIGS. 1 to 4.

The invention now being fully described, it will be apparent to one of ordinary skill in the art that any changes and modifications can be made thereto without departing from the spirit or scope of the invention as set forth herein.

What is claimed is:

1. In a tubular cannon including a gun barrel and a breechblock wedge for closing a breech end of the gun barrel, an ejector system for the extraction of cartridge casings or cartridge bottoms from the cannon, comprising:

a breech ring disposed at the breech end of the gun barrel;

first and second ejectors having respective recesses;

means for mounting said ejectors adjacent the breech end of the gun barrel for linear displacement parallel to the longitudinal axis of the gun barrel, said means for mounting said ejectors comprising first and second longitudinally extending grooves which are formed in the breech ring and into which a respective one of said ejectors extends;

first and second ejector claws, each connected to a respective one of said ejectors for grasping a rear of a cartridge casing;

first and second ejector levers each having an L-shaped configuration comprised of first and second arms, each said first arm extending into a respective one of said recess to slidingly engage the respective said ejector in a displaceable manner, said ejector levers and the associated said ejectors and ejector claws being symmetrically disposed relative to said longitudinal axis of the gun barrel;

means for mounting said first and second ejector levers adjacent said breech end of said gun barrel for pivotal movement about an axis extending perpendicular to an axis parallel to said longitudinal axis of said gun barrel, so that pivoting of said levers causes said linear displacement of said ejectors; and means for engaging the respective second arms of said ejector levers to initiate said pivotal movement of said levers during opening of said breechblock.

2. Apparatus as defined in claim 1 wherein each of said longitudinally extending grooves is T-shaped in cross-section and each of said ejectors has a corresponding T-shape.

3. Apparatus as defined in claim 1, wherein said means for engaging comprises respective cams provided on said breechblock.

4. Apparatus as defined in claim 1, wherein each of said ejector claws is connected in one piece with the corresponding one of said ejectors.

5. Apparatus as defined in claim 1, wherein each of said ejector claws is pivotally mounted on the corresponding one of said ejectors.

* * * * *